United States Patent [19]

Nurkowski

[11] Patent Number: 4,627,615

[45] Date of Patent: Dec. 9, 1986

[54] PROGRESSIVE WEIGHT RESISTANCE WEIGHTLIFTING MECHANISM

[76] Inventor: Paul S. Nurkowski, 50 Goodwin Parkway, Sewell, N.J. 08080

[21] Appl. No.: 670,091

[22] Filed: Nov. 13, 1984

[51] Int. Cl.[4] ..... A63B 21/06

[52] U.S. Cl. ..... 272/118; 272/DIG. 4

[58] Field of Search ..... 272/118, 22, 23, DIG. 4

[56] References Cited

U.S. PATENT DOCUMENTS

| | | | |
|---|---|---|---|
| Re. 31,170 | 3/1983 | Mazman | 272/118 |
| 3,257,111 | 6/1966 | Martin | 272/118 |
| 3,858,873 | 1/1975 | Jones | 272/58 |
| 3,912,261 | 10/1975 | Lambert | 272/58 |
| 3,912,263 | 10/1975 | Yatso | 272/118 |
| 4,200,279 | 4/1980 | Lambert | 272/118 |
| 4,311,305 | 1/1982 | Lambert | 272/118 |
| 4,349,192 | 9/1982 | Lambert, Jr. et al. | 272/118 |
| 4,387,893 | 6/1983 | Baldwin | 272/118 |
| 4,511,137 | 4/1985 | Jones | 272/118 |

*Primary Examiner*—Robert E. Bagwill

*Assistant Examiner*—Arnold W. Kramer

*Attorney, Agent, or Firm*—Seidel, Gonda, Goldhammer & Abbott

[57] ABSTRACT

A progressive resistance mechanism suitable for use with a weightlifting machine as provided having a base, a plurality of spaced vertical guide members, a carriage vertically reciprocating along the guide members and a plurality of weight stacks restingly supported by the base. An apertured selector post is slidably disposed through each stack and has a first pin for attaching a selected subset of weights from the stack for upward movement. A second pin on each selector post is provided for locking a slidable collar at selected positions on the post above the carriage. The collars may thus be set at different distances above the carriage. The upward-travelling carriage engages each collar in sequence to serially lift the associated weight stacks. The user thereby experiences progressively increasing weight resistance during the course of a single repetition.

14 Claims, 8 Drawing Figures

FIG. 4
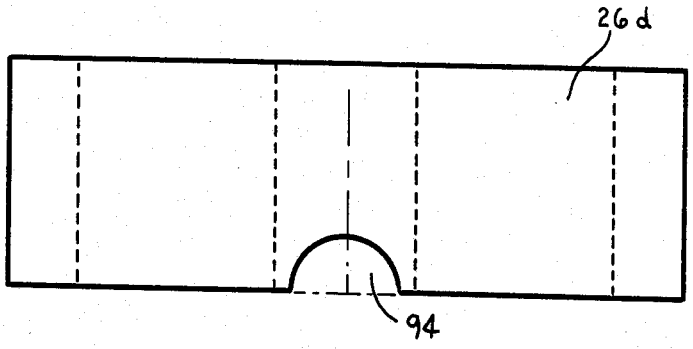
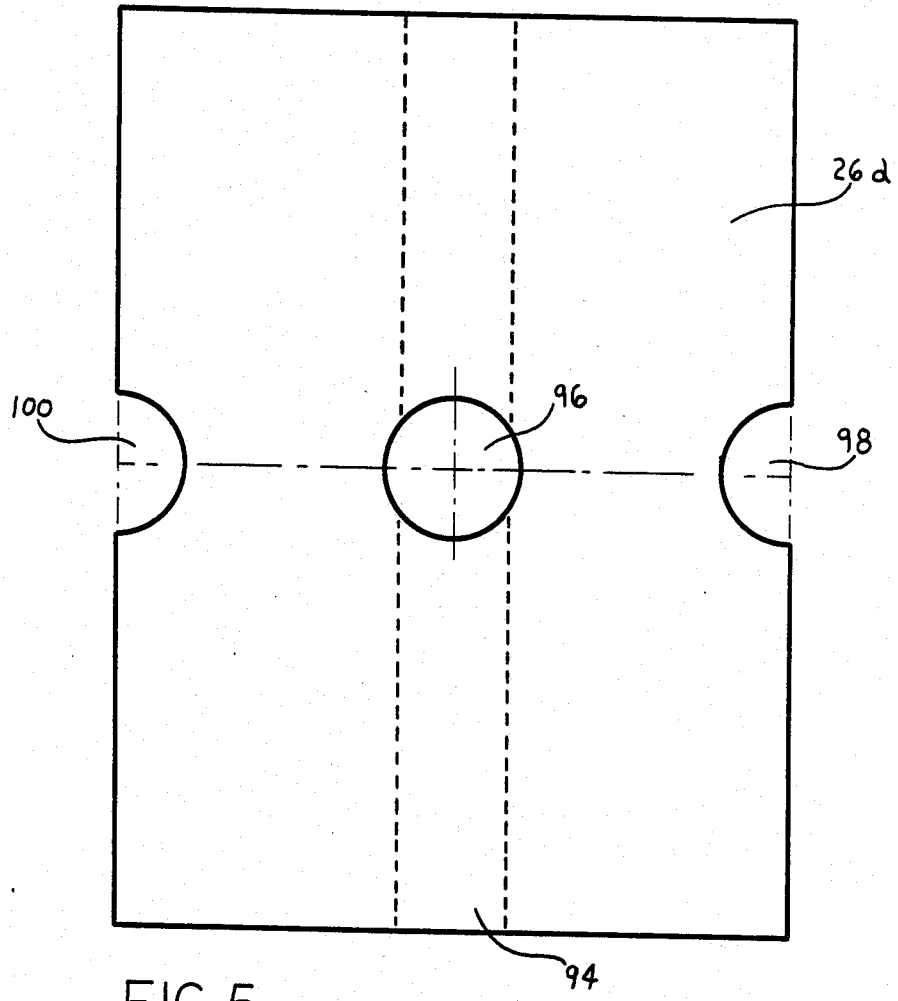
FIG. 5

PROGRESSIVE WEIGHT RESISTANCE WEIGHTLIFTING MECHANISM

BACKGROUND OF THE INVENTION

1. Field Of The Invention

This invention relates in general to certain new and useful improvements in weightlifting machines. More particularly, the invention relates to a vertical weight array mechanism permitting user selection of a variable weight resistance throughout the movement of an exercise repetition, and the selection of weight engaging positions throughout the movement of an exercise repetition.

2. Brief Description Of The Prior Art

In recent years, weightlifting has been accepted as a method of enhancing athletic performance. A large number of weightlifting apparatus have been introduced whose function is either multiple or single exercise specialization. In most constructions, the weightlifting apparatus comprises an upstanding frame, a vertical array of weights which may be selectively introduced, and a cable or other appropriate lifting means secured to the vertical array of weights for initiating a vertical lift movement of the weights. The user of the apparatus engages the lifting means and attempts to lift the selectively introduced weights. The weight load is constant throughout the course of any repetition. While many of these apparatuses have been effective in enabling one to increase muscular size and strength, considerable time and effort can be expended to develop a given muscle throughout its complete range of movement.

Each human body is different. Particularly, no skeletal configuration has like bones of equal length. Thus, the skeletal (or lever) angles are different between bodies. Since skeletal angles also vary during performance of an exercise repetition, appropriate weight load selection is necessary to accommodate each variation in this angular leverage. A static weight load apparatus is inappropriate for such purposes.

U.S. Pat. No. Re. 31,170 discloses a method of progressive resistance wherein the resistance generated by a selected static weight load increases during the performance of an exercise. Stacked weights are manipulated by the user through a lever arm. The lever arm is pivoted to a frame, and passes through a yoke in a lift rod. A roller mounted on the yoke is carried on the upper surface of the lever arm. As the lever arm is raised, the roller on the lift rod moves on the lever arm to restrict the user's mechanical advantage and increase his effective load. The nonlinear path enables the device to progressively increase resistance throughout the exercise. A drawback of this device is that the nonlinear path is predetermined. The device cannot be adjusted to account for varying skeletal configurations. Thus, it suffers from the same disadvantage of other prior art progressive weight resistance mechanisms, namely an inability to account for varying skeletal configurations.

U.S. Pat. Nos. 3,858,873, 3,912,261, 4,200,279, 4,311,305, and 4,387,893 disclose progressive resistance weightlifting mechanisms. By introducing a cammed pulley in the lifting means, increased resistance during the performance of each repetition is experienced.

Although the inventions of the aforementioned patents are innovative in providing progressive resistance throughout an exercise movement, by virtue of their construction the user encounters strict limitations due to predesigned mechanical characteristics.

SUMMARY OF THE INVENTION

The present invention relates to a progressive resistance weightlifting machine which is comprised of a base, a plurality of vertical guide members emanating from the base, a vertically-reciprocative carriage engaging the vertical guides, a plurality of weight stacks beneath the carriage, weight-engaging means associated with each weight stack, and means for selectively and independently engaging each weight stack as the carriage travels upward. The vertical guide members separate the weight arrays and stablize them during movement. The weight-engaging means associated with each weight stack comprises a selector post slidable through the weight stack. Each selector post has a first pin means disposed beneath the carriage for attaching a selected subset of weights for upward displacement with the selector post. The selector posts extend through apertures in the center of each weight in the stack.

Each weight stack is selectively and independently engaged. At least one selector post has a second pin means adapted for locking a slidable collar at selected distances along the post above the carriage. The upwardly-traveling carriage engages the various pre-set collars in sequence to lift the associated selector posts. The weight stacks depending from the selector posts are thus serially engaged during the course of a single user repetition.

Guide rollers rotatably mounted in slots in the carriage engage the vertical guide members to stabilize the carriage during reciprocation.

A vertical lifting means may be attached to the carriage. The vertical lifting means communicates the user movement to the carriage and the weight stacks depending therefrom. The vertical lifting means may take the form of a cable. The carriage is raised when the cable is under sufficient tension. The vertical lifting means may also take the form of a handlebar of the type disclosed in U.S. Pat. Nos. 3,912,263 and 4,339,125. Other vertical lifting means are known to those skilled in the art.

The vertical lifting means may be attached to any of a number of user engagement stations such as: bench press (supine press) station, leg press station, military press (sitting press) station, shoulder shrug station, standing press station, butterfly station, curling station, bustline developing station, pectoral and deltoid developing station, torso exercising station and other exercising stations.

Accordingly, it is therefore an object of the present invention to provide a progressive resistance weightlifting machine comprised of a vertically-reciprocative carriage engaging vertical guide members, a plurality of weight stacks depending from the carriage, and means for selectively and independently engaging each weight stack as the carriage travels upward.

It is an object of the invention to provide a progressive weight resistance machine which may be adjusted to allow for varying skeletal configurations.

It is an object of the invention to provide a machine which is highly effective in its operation and which can be constructed at a relatively low cost.

It is an object of the present invention to provide a machine which will increase muscular strength throughout the full range of muscular movement.

It is an object of the invention to provide a machine to reduce the time required to fully develop a particular muscle throughout the full range of the muscle's movements.

It is an object of the invention to provide a machine to reduce the number of exercises necessary to develop a muscle throughout the muscle's complete range of movement.

It is an object of the invention to provide a weightlifting machine which may be constructed for use in a single or multi-stationed embodiment.

It is an object of the invention to provide a weightlifting machine which can be adjusted according to the individual needs of the user.

It is an object of the present invention to provide a machine of the type stated which neither restricts nor limits weight load throughout an exercise movement by predesigned mechanical characteristics.

Other objects and advantages will be apparent from the following disclosure.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 4 is a front view of a single weight of the machine.

FIG. 5 is a top plan view of a single weight of the machine.

DETAILED DESCRIPTION OF THE DRAWINGS

Figure 1:
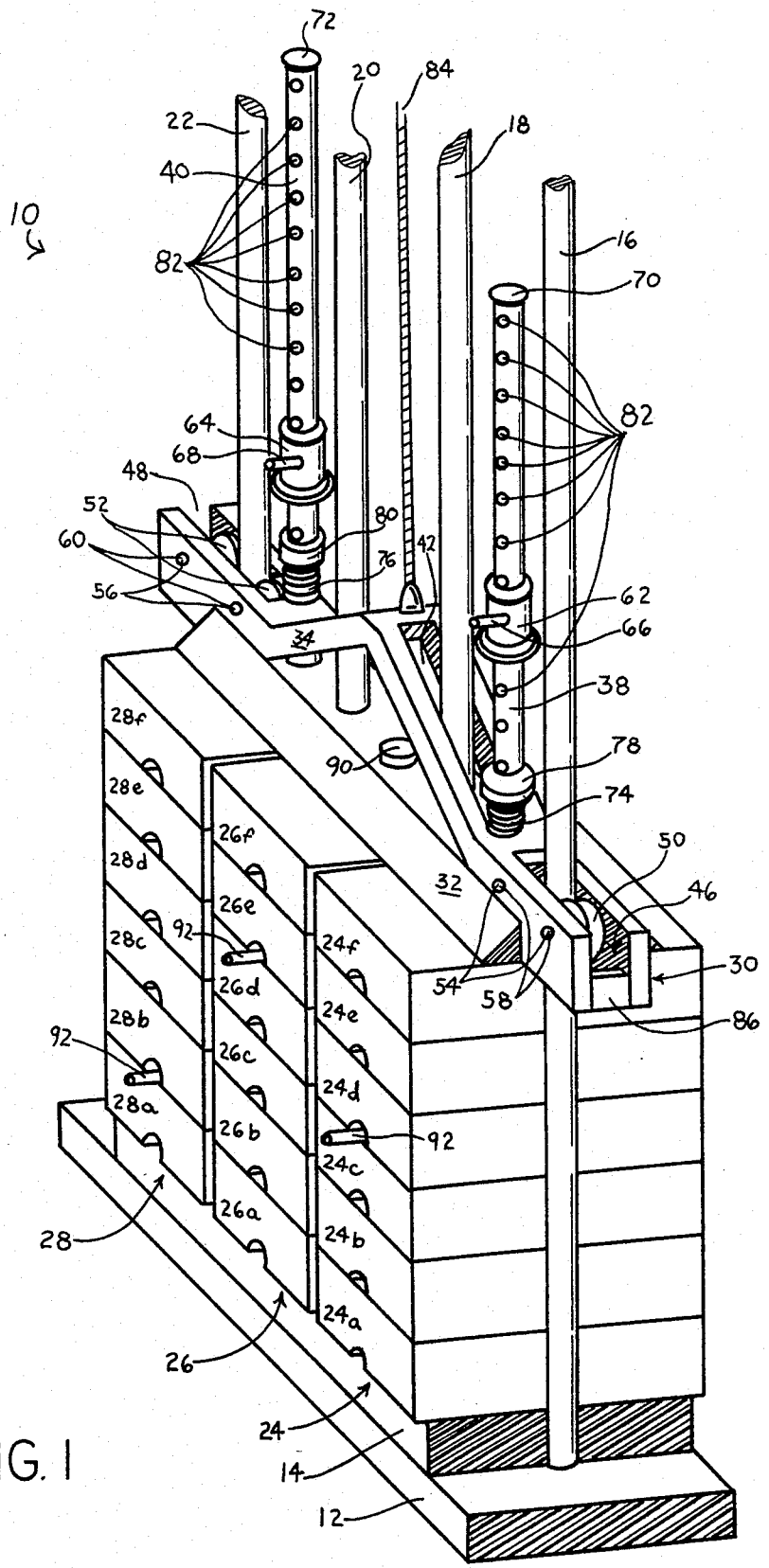
FIG. 1 is a perspective view of a progressive resistance weightlifting machine constructed in accordance with and embodying the present invention.

Referring to the drawings, wherein like numerals indicate like elements, there is shown in FIG. 1, a progressive resistance weightlifting machine 10 at rest. A base 12 rests on a floor or other level surface (not shown). A base plate 14 is fixedly secured to base 12. Vertical guide members 16, 18, 20 and 22 are affixed perpendicularly to the base plate 14 and extend upwardly therefrom. Weight stacks 24, 26, and 28 rest upon the base plate 14. Stack 24 is positioned between guide members 16 and 18. Stack 26 is positioned between guide members 18 and 20. Stack 28 is positioned between guide members 20 and 22. Each of the weight stacks 24, 26 and 28 are composed of a plurality of stacked weights designated 24*a–f*, 26*a–f* and 28*a–f*, respectively. Although each of the weights 24*a–f*, 26*a–f* and 28*a–f* are individual weights of equal magnitude, weights of dissimilar magnitude may be used.

Although the weightlifting machine of the present invention is shown here for the purposes of illustration with three weight stacks, any number of such stacks in excess of one is within the scope of the present invention.

A vertically-reciprocative carriage 30 rests upon the weight stacks. The vertical movement of carriage 30 and the weight stacks is guided by the vertical guide members 16, 18, 20 and 22. Carriage 30 has a lower frame 32 and an upper frame 34. Lower frame 32 is generally rectangular with a length less than or equal to the distance between vertical guide members 16 and 22 and a width less than a weight, such as 24*f*. The upper frame 34 is generally an inverted V-shaped member. Upper frame guide slots 46 and 48 extend through respective ends of upper frame 34.

A pair of guide rollers 50 are rotatably mounted on parallel shafts 58 which extend laterally across slot 46. (The left roller of the roller pair 50 can not be seen in FIG. 1) Guide member 16 is sandwiched between guide rollers 50. Guide rollers 50 are grooved for engaging guide member 16. The ends of each shaft 58 are journaled within the side walls of the upper frame guide slots 46 in shaft bearings 54. Likewise, at the other end of upper frame 34, a pair of guide rollers 52 are rotatably mounted on parallel shafts 60 which extend laterally across slot 48. Guide member 22 is sandwiched between guide rollers 52. Guide rollers 52, like guide rollers 50, are grooved for engaging the associated guide member 22. The shafts 60 are journaled in side walls of the slot 48 in shaft bearings 56.

Upper frame slots 42 and 44 extend through the upper frame 34 between guide slots 46 and 48 to assist horizontal stability of carriage 30 (upper frame slot 44 cannot be seen in FIG. 1). Guide member 18 passes through slots 42, while guide member 20 passes through slot 44. A cable 84 is attached to the apex of the V-shaped upper frame 34. The other end of the cable 84 is affixed to user engagement stations. These stations include, but are not limited to, bench press station, leg press station, military press station, shoulder shrug station, standing press station, butterfly station, curling station, bust line developing station, pectoral and deltoid developing station, torso exercising station and other exercising stations. A tie bar 86 extends across the end of upper frame guide slots 46 to stabilize the side walls of slot 46. Tie bar 88, likewise, extends across slot 48. (Tie bar 88 can not be seen in FIG. 1). Weight selector posts 38 and 40 are located between vertical guide members 16 and 18 8 and vertical guide members 20 and 22, respectively.

Figure 2:
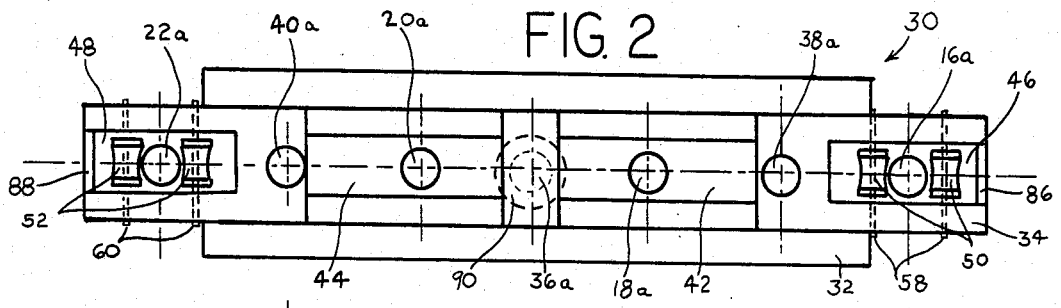
FIG. 2 is a top plan view, of a weight supporting frame of the machine of the present invention.

Referring to FIG. 2, there is shown a top plan view of carriage 30. Guide holes 16*a*, 18*a*, 20*a*, and 22*a* for receiving like-numeraled vertical guide members are shown disposed along an imaginary center line running the length of carriage 30. Each hole 16*a*, 18*a*, 20*a* and 22*a* has a diameter slightly greater than its corresponding guide member. This allows free sliding between guide member and carriage, without increasing horizontal instability of the carriage. Holes 36*a*, 38*a* and 40*a* in carriage 30 have a diameter just greater than their like-numeraled weight selector posts to allow free sliding between the posts and the carriage.

Figure 3:
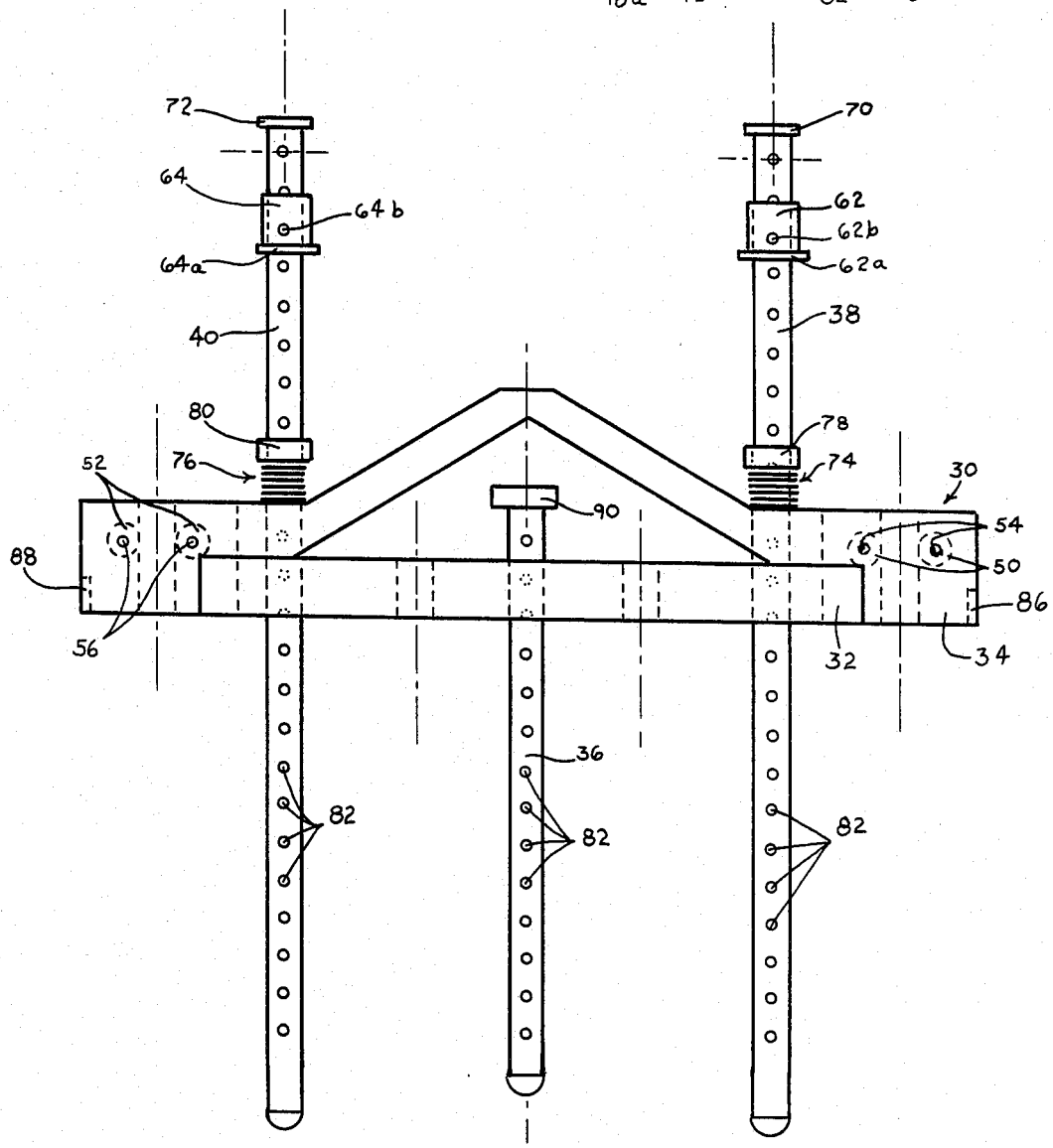
FIG. 3 is a fragmentary front elevation view of the weight supporting frame of the machine.

Referring to FIG. 3, there is shown a side view of the carriage 30 with weight selector posts 36, 38 and 40 slidably penetrating therethrough. The middle weight selector post 36 is slideably disposed through the lower frame 32. Post 36 penetrates through weight stack 26 (not shown). The side weight selector posts 38 and 40 are slideably penetrating through both the upper frame 34 and the lower frame 32 of carriage 30. Side weight selector posts 38 and 40 penetrates weight stacks 24 and 28 respectively. Stops 70, 72 and 90 are located at the upper most end of posts 38, 40 and 36, respectively, so to prevent the posts from sliding through the carriage 30. Each post has a plurality of apertures 82 equally spaced along its length and which penetrate through the diameter of the posts. Collars 62 and 64 with affixed collar flanges 62*a* and 64*a*, respectively are slideably disposed upon the posts 38 and 40 below the stops 70 and 72 and above carraige 30. Shock absorbing means are disposed upon the posts between the carriage and the collars. The shock absorbing means may comprise a suitable spring means, such as springs 74 and 76. Springs 74 and 76 and their corresponding O-rings 78 and 80 are mounted upon the upper frame 34 and are coiled around the posts 38 and 40. The springs 74 and 76 and their respective O-rings 78 and 80 are positioned below the collar flanges 62*a* and 64*a*, respectively. A collar aperture 62*b* is disposed through the diameter of the collar 62. Collar aperture 64*b* is likewise disposed through collar 64. The apertures may be aligned with mating apertures 82 of their respective posts 38 and 40 so that a pin (numbered 66 and 68 in FIG. 1) may fix the position of the collars 62 and 64 on their respective posts. The collars 62 and 64 when locked in place upon the posts 38 and 40 will be engaged as the carriage 30 travels in an upwardly direction. By so fixing the collars at various positions along their respective posts, the weights depending therefrom will be engaged at different points along the upward movement of the carriage 30. The spring and O-ring combination absorbs shock forces when the carriage 30 contacts the locked collars.

Referring to FIGS. 4 and 5, there is shown a representative weight 26*d*. In FIG. 4, a front view of the weight 26*d* is shown. A weight pin slot 94 is disposed along the bottom surface of the weight 26*d*. In FIG. 5, a top view of the representative weight 26*d* is shown with weight slot 96 through the center of the weight 26*d*. The weight slot 96 is for selectable slidable engagement with a weight selector post such as post 38, 40 or 36. Guide keyways 98 and 100 are disposed in either side of the weight 26*d* perpendicular to the side with slot 94. The guide keyways 98 and 100 slidably engage a pair of adjacent vertical guide members, such as guide members 18 and 20, to stabilize the weight stack. The guide keyways 98 and 100 prevent the weight 26*d* from making any unwanted movements either front to back or side to side.

Referring to FIGS. 1, 6, 7 and 8 an illustration of the mechanism's operation is set forth. In FIG. 1, the mechanism 10 is shown at rest. No tension is exerted on the cable 84 from the user engagement station (not shown). Pins 92 are set in various weight slots along the weight stacks 24, 26 and 28. For illustration, pins 92 are set below weight 24*d* of stack 24, below weight 26*e* of stack 26, and below weight 28*b* of stack 28. Each of the aforementioned pins 92, set in the various weight stacks 24, 26 and 28, are in engagement with their respective weight selector posts 38, 36 and 40. Collars 62 and 64 are secured at various positions on their respective posts 38 and 40 and locked into place by the use of pins 66 and 68.

Figure 6:
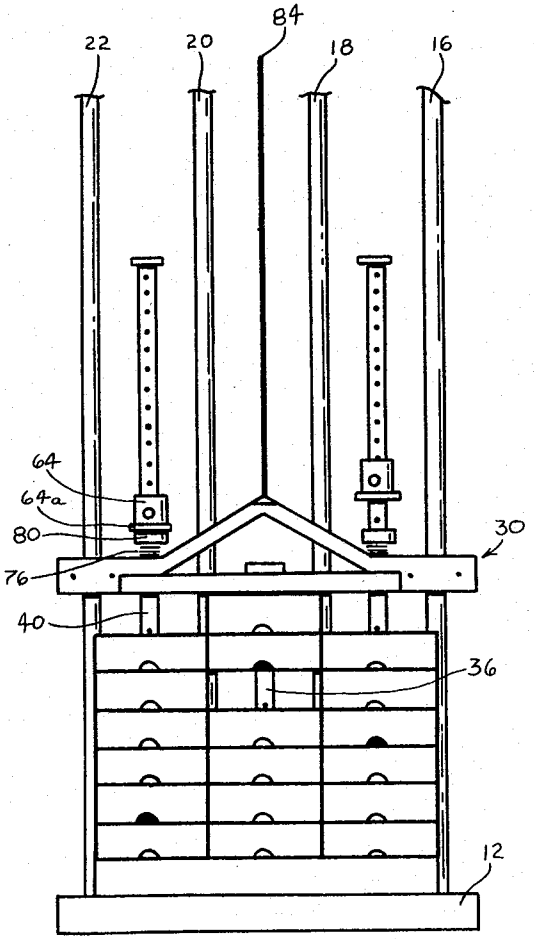

In FIG. 6, tension has been placed on the cable 84 causing the carriage 30 to travel in an upwardly direction in relation to the base 12. Carriage 30 rides vertically, but is stabilized in a horizontal plane by cooperation with the vertical guide members 16, 18, 20 and 22. The resistance to the upward travel of the carriage 30 is due to the weights affixed to weight selector post 36, which begin traveling upward with weight selector post 36. As the carriage continues upward, O-ring 80 will engage collar 64 on post 40 along collar flange 64*a* (as shown in FIG. 6). Shock forces due to the engagement of the collar 64 are reduced by the spring 76 and the horizontal stability given to carriage 30 by the vertical guide members 16, 18, 20 and 22. The collar 64 completely engages with the O-ring 80, thus supplying the additional resistance of the weights which depend from post 40. Resistance to the upward movement of carriage 30 is now due to the weights which depend from post 36 and 40.

Figure 7:
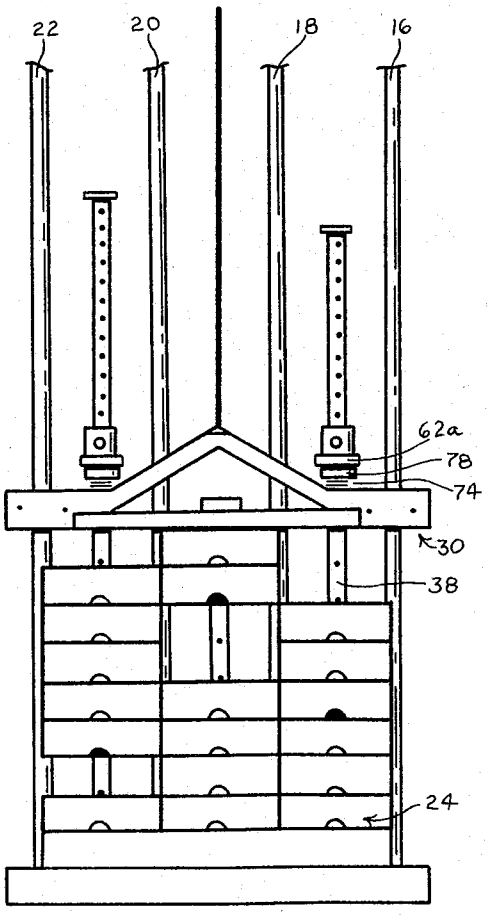

In FIG. 7, carriage 30 has traveled further along its upward path. The O-ring 78 is shown engaged with the collar flange 62*a* of post 38. Again, the shock due to the engagement of O-ring 78 and the collar flange 62*a* is minimized by the spring 74 and the horizontal stability provided by carriage 30 in engagement with the vertical support members 16, 18, 20 and 22. Resistance to movement of carriage 30 is now due to the weights which depend from post 36, 38 and 40.

Figure 8:
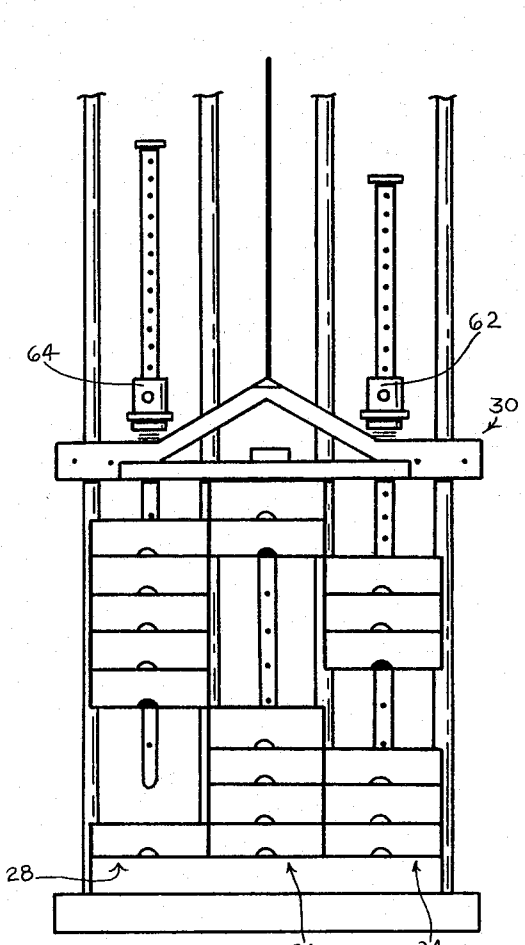
FIGS. 6 through 8 are schematic views of the progressive resistance weightlifting machine illustrating weight selection and engagement positions in accordance with the present invention.

In FIG. 8, the carriage 30 has travelled further along its upward path. Weights from all the stacks 24, 26 and 28 now resist the further upward movement of carriage 30.

The collars 62 and 64 may be affixed upon the associated weight selector posts at any position so to adjust for the skeletal leverage of the individual user. The number of weights activated in each weight stack may also be varied so to fully exercise a muscle through its complete rotation. It is understood that this device may be adapted to work with any muscle of the body such as arms or legs or the back or the stomach.

The present invention may be embodied in other specific forms without departing from the spirit or essential attributes thereof and, accordingly, reference should be made to the appended claims, rather than to the the foregoing specification, as indicating the scope of the invention.

I claim:

1. Progressive resistance mechanism for a weight-lifting machine comprising:

(a) a base;

(b) a plurality of spaced vertical guide members upstanding from the base;

(c) a carriage adapted for vertically reciprocative motion along said vertical guide members;

(d) a plurality of weight stacks on said base beneath the carriage, each stack including a plurality of stacked weights;

(e) an upright vertically movable selector post for each stack extending from below the lowermost weight of the stack to above the carriage;

(f) means for connecting the lowermost weight of a selected number of weights to said post; and (g) carriage engaging means on said post above the carriage for engagement by said carriage on upward movement of said carriage, the carriage engaging means on at least one post being vertically adjustable with respect to said post, the independent adjustment of the carriage engaging means on said post resulting in selected progressive sequential weight resistance during a single user repetition.

2. The mechanism according to claim 1 further comprising a vertical reciprocating means affixed to the carriage for activation by a user engagement means.

3. The mechanism according to claim 2 wherein the vertical lifting means is a cable.

4. The mechanism according to claim 1 whereby guide rollers rotatably mounted in slots in the carriage engage the vertical guide members to stabilize the carriage during reciprocation.

5. A mechanism according to claim 1 wherein the means for connecting the lowermost weight of a selected number of weights to each post comprises a first pin means insertable in one of a plurality of vertically spaced apertures in the post.

6. A mechanism according to claim 5 wherein the vertically adjustable carriage engaging means comprises a second pin means insertable in one of the vertically spaced apertures in said post for fixing a slidable collar at a selected distance on the post above the carriage.

7. The mechanism according to claim 6 wherein a shock absorbing means is disposed on the selector post between the collar and the carriage.

8. The mechanism according to claim 7 wherein the shock absorbing means comprises a spring means.

9. The mechanism according to claim 8 wherein the spring means comprises a coiled spring.

10. A mechanism according to claim 6 wherein guide keyways on opposite sides of each weight stack contact adjacent guide members to stabilize the stack.

11. The mechanism according to claim 10 wherein a vertical lifting means is associated with the carriage.

12. The mechanism according to claim 10 having two weight stacks.

13. The mechanism according to claim 10 having three weight stacks.

14. A progressive weight resistance mechanism for a weightlifting machine comprising:

(a) a base;

(b) at least three spaced vertical guide members upstanding from the base;

(c) a carriage cooperating with said vertical guide members, said carriage adapted for vertical reciprocative motion along said vertical guide members;

(d) a stack of a plurality of weights between pairs of vertical guide members with each weight having a pin slot;

(e) an apertured selector post associated with each weight stack, each selector post being slidable through an aperture in the carriage and extending downward into the weight stack, a first pin insertable into a slot in the lowermost weight of a selected subset of weights of the stack and through an aperture in said selector post to add the selected subset of weights to the post;

(f) a stop on the upper end each of selector post;

(g) a slidable collar on at least one selector post above the carriage, said collar having an aperture and a second pin insertable through said collar aperture and a selected mating aperture in the selector post to lock the collar into a selected position above the carriage whereby the carriage engages the collar and so moves the selector posts in the mechanism to lift the selected subsets of selected weights in a progressive sequence determined by the carriage sequentially engaging said collars or stops during a single user repetition.

* * * * *